US011834752B2

(12) United States Patent
Sklar et al.

(10) Patent No.: US 11,834,752 B2
(45) Date of Patent: Dec. 5, 2023

(54) ELECTROPLATING SYSTEMS AND METHODS FOR WEAR-RESISTANT COATINGS

(71) Applicant: HONEYWELL INTERNATIONAL INC., Charlotte, NC (US)

(72) Inventors: Glenn Sklar, Morris Plains, NJ (US); James Piascik, Morris Plains, NJ (US); Joseph Mintzer, Tempe, AZ (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 0 days.

(21) Appl. No.: 17/571,952

(22) Filed: Jan. 10, 2022

(65) Prior Publication Data

US 2022/0349083 A1 Nov. 3, 2022

Related U.S. Application Data

(60) Provisional application No. 63/180,976, filed on Apr. 28, 2021.

(51) Int. Cl.

| | |
|---|---|
| ***C25D 17/02*** | (2006.01) |
| ***C25D 17/12*** | (2006.01) |
| ***C25D 17/00*** | (2006.01) |

(52) U.S. Cl.

CPC ..... *C25D 17/008* (2013.01); *C25D 17/02* (2013.01); *C25D 17/12* (2013.01)

(58) Field of Classification Search

CPC ..... C25D 17/008; C25D 3/18–18

See application file for complete search history.

(56) References Cited

U.S. PATENT DOCUMENTS

| | | | | |
|---|---|---|---|---|
| 2,898,285 A * | 8/1959 | Henson | C25D 17/08 204/297.06 |
| 4,650,549 A * | 3/1987 | Morgan | C25D 7/04 204/272 |
| 5,098,542 A * | 3/1992 | Reinhardt | C25D 7/04 204/297.05 |
| 2019/0003070 A1* | 1/2019 | Piascik | C25D 5/003 |
| 2019/0292674 A1* | 9/2019 | Ilgar | C23C 30/00 |

FOREIGN PATENT DOCUMENTS

| | | | |
|---|---|---|---|
| CN | 206256184 U * | 6/2017 | |
| WO | WO-9910563 A2 * | 3/1999 | C25D 17/08 |

OTHER PUBLICATIONS

Stiegler et al., Machine Translation, W.O. Int'l Pub. No. 99/10563 A2 (Year: 1999).*

Gong et al., Machine Translation, CN-206256184-U (Year: 2017).*

Huang, Original & Machine Translation, CN 106591911 A (Year: 2017).*

* cited by examiner

*Primary Examiner* — Hosung Chung

(74) *Attorney, Agent, or Firm* — Lorenz & Kopf LLP

(57) ABSTRACT

An electroplating system includes a tank functioning as an anode, wherein the tank is configured in a horizontal orientation having a length greater than its height, a component part disposed within the tank and functioning as a cathode, an electrical connection, coupled to the anode and cathode, for providing an electric current, and a supply line for delivering an electrolytic fluid to within the tank.

16 Claims, 4 Drawing Sheets

ELECTROPLATING SYSTEMS AND METHODS FOR WEAR-RESISTANT COATINGS

CROSS-REFERENCE TO RELATED APPLICATIONS

This application claims the benefit of U.S. Provisional Application No. 63/180,976, filed Apr. 28, 2021, the contents of which are herein incorporated by reference in their entirety.

TECHNICAL FIELD

The following disclosure relates generally to electroplating systems to produce wear resistant coatings, as well as to methods for the formation of such wear resistant coatings.

BACKGROUND

There is a need for low cost, high performance wear resistant coatings across various industries. In the oil and gas industry, for example, there exists a continued demand for wear resistant coatings suitable for deposition over components utilized in downhole drilling applications, such as lobed rotor shafts of the type found in the power section of steerable and non-steerable downhole mud rotors. Ideally, such wear resistant coatings are relatively durable and possess high hardness values exceeding, for example, 900 Vickers Pyramid Number (HV). It may also be desirable for such wear resistant coatings to serve as a barrier against undesired chemical reactions with environmental contaminants and/or additives that may intentionally be added to drilling mud. For example, in the case of downhill drilling applications, such wear resistant coatings beneficially shield the underlying substrate or component from exposure to environmental acids, sulfides, and salts, which could corrode or otherwise structurally degrade the underlying component.

Specialized coatings have been developed for usage in downhole drilling applications and other applications demanding high wear and corrosion resistance. Examples of such coatings include hard chrome platings and tungsten-carbide (WC) coatings, which may include a metal binder (e.g., 86% WC; 10% Co; 4% Cr). Such legacy wear resistant coatings are, however, typically limited in one or more respects. For example, the High Velocity Oxygen Fuel (HVOF) deposition processes utilized to deposit WC coatings are often costly to perform. Further, in the case of both hard chrome platings and WC coatings, such coatings are typically quite hard and brittle as initially deposited. As a result, such legacy wear resistant coatings pose additional challenges when machining is desirably performed following coating deposition to define structural features, to satisfy dimensional tolerances, or meet surface finish requirements. Post-coating machining, such as grinding to satisfy surface finish requirements, is thus a costly and time-consuming process, often requiring diamond cutting tools and specialized operations. Post-coating machining can also potentially result in damage, such as chipping or cracking, of the newly-deposited wear resistant coating. This may not only adversely impact the structural integrity of the wear resistant coating, but may also render the coating prone to the ingress of environmental contaminants as noted above.

Such rotor sections for the oil and gas industry may range from about 2 to about 30 feet long and have a complex geometry and material handling difficulty. Conventionally, components are plated vertically in open electroplating tanks, which are costly to install. Open vertical electroplating tanks require high ceilings, and the risk of gas evolution and tank leakage is high. Moreover, while most vertical tanks are below ground level, these tanks require ceilings that are higher than the part length. Drying and passivation of parts may also occur using vertically-oriented electroplating tanks. Furthermore, maintenance of vertical tanks is labor intensive and causes significant downtime, and rotation of parts in vertical electroplating tanks is not feasible. Heavy parts must be transferred from one tank to another between process steps, which increases processing time and creates safety and quality concerns due to instability of the part during transfer. Still further, components may need to be plated for many extra hours in order to obtain sufficient coating thickness in the valleys. This results in possible over-plating of the peaks, which then need costly grinding to be performed.

There thus exists an ongoing demand for high performance, wear resistant coatings and methods for forming such wear resistant coatings, which can be performed in a relatively cost efficient, timely, and reliable manner. It would be particularly desirable for such coating formation methods to ease post-coating machining of the coating, while achieving finished coatings with relatively high hardness values and other desirable properties. It would also be desirable for embodiments of wear resistant coatings to serve as effective environmental barriers by deterring the penetration of environment contaminants and/or additives that may intentionally be added to drilling mud through the coating thickness and to the underlying substrate or component. Other desirable features and characteristics of embodiments of the present invention will become apparent from the subsequent Detailed Description and the appended Claims, taken in conjunction with the accompanying drawings and the foregoing Background.

BRIEF SUMMARY

In accordance with one exemplary embodiment, disclosed is an electroplating system which includes a tank that comprises an anode, and is configured in a horizontal orientation having a length greater than its height, a component part disposed within the tank and functioning as a cathode, an electrical connection, coupled to the anode and cathode, for providing an electric current, and a supply line for delivering an electrolytic fluid to within the tank.

In accordance with another exemplary embodiment, a method for electroplating a component part includes disposing the component part in an electroplating tank, the tank comprises an anode, and is configured in a horizontal orientation having a length greater than its height, introducing an electrolytic fluid into the tank along with the component part, and applying an electroplating current to the component part and the anode, the component part functioning as a cathode.

This brief summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE FIGURES

The present disclosure will hereinafter be described in conjunction with the following drawing figures, wherein like numerals denote like elements, and wherein.

DETAILED DESCRIPTION

Figure 1:
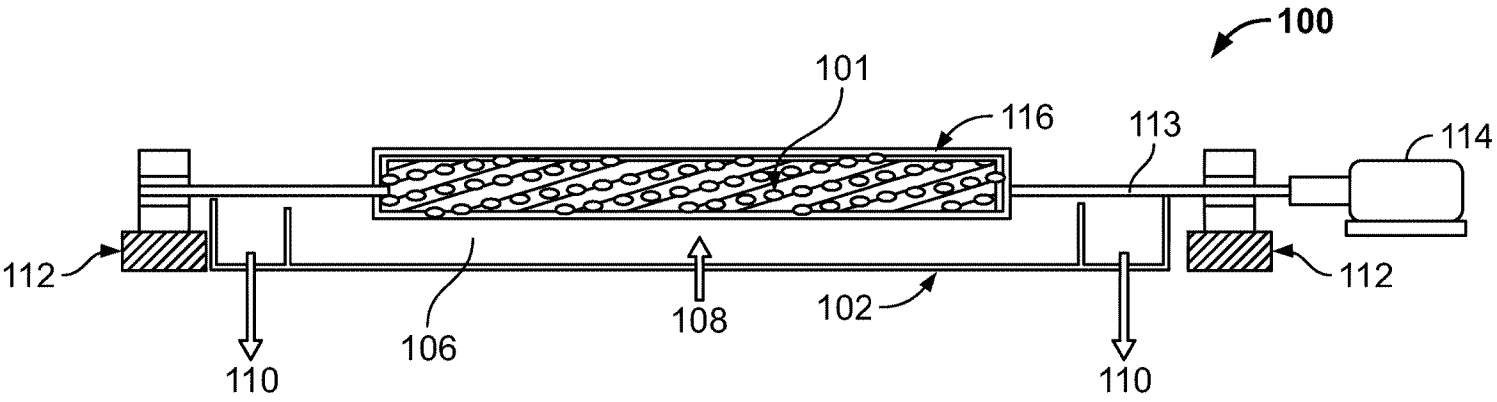
FIG. 1 is a side cross-sectional view illustrating a horizontally-oriented system for electroplating in accordance with an embodiment of the present disclosure.

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

Unless specifically stated or obvious from context, as used herein, the term "about" is understood as within a range of normal tolerance in the art, for example within 2 standard deviations of the mean. "About" can be understood as within 10%, 5%, 1%, 0.5%, 0.1%, 0.05%, or 0.01% of the stated value. Unless otherwise clear from the context, all numerical values provided herein are modified by the term "about."

Embodiments of the present disclosure provide improved electroplating systems and methods for providing a wear resistant coating onto large components, such as mud rotors and other industrial equipment. A wear resistant coating, however, can be formed over any type of component, regardless of application or usage. This notwithstanding, the wear resistant coating may be particularly beneficial when formed over components subject to high wear conditions or corrosive environments during usage. In this regard, an exemplary implementation is a coated component in the form of a mud rotor shaft, which is contained in the power section of a downhole mud rotor. Mud rotor shafts can have any desired length, which may approach or exceed 10 meters in some implementations. Additionally, multiple mud rotor shafts may be joined together or joined in series to span the full depth of a given well. In addition to the mud rotor shaft, a downhole mud rotor further includes a tubular stator casing and an inner tubular sleeve which may be composed of a rubber or another polymer. The interior of sleeve is threaded or lobed in a twisting or spiral pattern. The twisting, lobed interior geometry of sleeve combines with the twisting, lobed outer geometry of the mud rotor shaft to form a sealed cavity, which varies in location as the rotor shaft rotates with respect to the sleeve and casing. During operation of the downhole mud rotor, a pressurized liquid is delivered into the sealed cavity, which varies in shape and location as the rotor shaft rotates, to drive rotation of the rotor shaft and a bit in which the mud rotor terminates. During mud rotor operations, relatively severe frictional forces or harsh abrasive forces may be exerted between the mating surfaces of the mud rotor shaft and sleeve. To stave-off premature wear of the rotor shaft and sleeve, a wear resistant coating is formed over the outer lobed surface of rotor shaft. Typically, the wear resistant coating is formed using electroplating.

Figure 2:
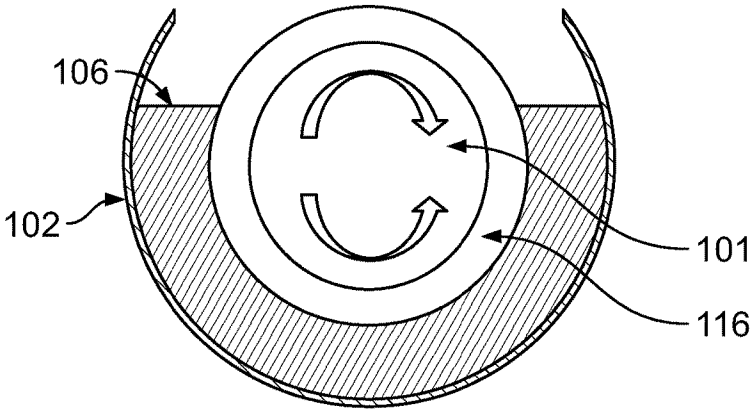
FIG. 2 is a longitudinal cross-sectional view illustrating the horizontally-oriented system for electroplating shown in FIG. 1.

In accordance with the present disclosure, as illustrated in FIGS. 1 and 2, large parts 101 with high surface relief (such as mud rotors) are plated with a wear resistant coating, such as cobalt-phosphorous (Co—P), chrome, nickel-tungsten (Ni—W), or nickel-phosphorous (Ni—P), for example among others, in a horizontal trough-like tank 102, which forms a component of electroplating system 100. For ease of illustration, a Co—P coating is referenced in this disclosure, but it is not limiting. The tank 102 is compact and comprises the anode electrode for the electroplating process. In this regard, the tank 102 could be coated with a suitable a catalytic coating, such as a mixed-metal-oxide (MMO) or platinum metal, or the tank 102 could have a suitable anode structure disposed on or near the tank bottom with the same contour.

A perforated shield 116 (preferably titanium) is placed between the cathode (part 101) and the anode (tank 102) to improve thickness uniformity across the depressions and elevations. The shield 116 is preferably positioned about half an inch from the anode (part 101). Use of the shield 116 decreases the plating ratio, which depends upon rotor diameter, the number of lobes, and height of lobes in a single process step. Electrical current may be provided through various electrical connections 112 to the tank 102 and the part 101.

The part 101 is also rotated utilizing a support shaft 113 and a motor 114 to improve thickness uniformity, facilitate processing solution 106 movement, and guarantee alloy composition and uniform particle distribution in slurry plating. A portion of the part 101 protrudes out of processing solution 106 to facilitate bubble breaking to prevent hydrogen pitting, as illustrated in FIGS. 1 and 2. The anode (mixed metal oxide on titanium or platinum coated titanium, for example) is common to all processing solutions. The part 101 remains in the same tank 102 during the entire plating operation and the processing solutions 106 are pumped, one by one to the processing tank 102 through one or more fill lines 108. At the completion of each process step, the processing solution 106 is pumped out of the tank 102 through one or more return lines 110. This is followed by a rinse step in which deionized water is pumped into the tank 102 through line(s) 108. The deionized water is then pumped out of the tank 102 through line(s) 110, and the next processing solution 106 is pumped into the tank 102 in preparation for the next process step.

Systems and methods in accordance with the present disclosure, such as shown in FIGS. 1 and 2, allow for uniform electroplating of Co—P wear resistant coating over the entire surface and reduce plating time. Material handling is simplified by horizontal orientation of the part 101 in an open "anode gutter" (e.g., tank 102), positioned just two-three feet above the industrial shop floor. Not only are tanks 102 no longer required to be about 20 to about 30 feet deep as in the previous vertical tank orientations, but are reduced to small volume reservoirs which flow through the anode gutter 102. Parts 101 no longer have to be moved from tank to tank, but can remain in the same horizontal tank 102 while processing solution 106 are pumped in and out.

It should be noted that the chemistry for a suitable wear-resistant coating in accordance with the present disclosure has been described in commonly-assigned U.S. Patent Application Publication US 2019/0292674 A1, the contents of which are herein incorporated by reference in their entirety. For example, as disclosed therein, the wear resistant coating contains a precipitation-hardened alloy body, which is produced over the component surface utilizing a combination of deposition, machining, and heat treatment processes. The wear resistant coating may consist wholly or entirely of a Co—P alloy body in certain implementations. In other embodiments, the wear resistant coating may contain one or more additional material layers, such as a bond-coat or a barrier layer, which may be combined with the alloy body in a stacked relationship. In such embodiments, the precipitation-hardened alloy body will typically be the outermost layer or portion of the wear resistant coating and may consequently be considered a topcoat. The precipitation-hardened alloy body may or may not directly contact the surface of part 101, depending upon whether the wear resistant coating is produced to contain a bond-coat, barrier layer, or other material layer between the coating and component surface. Wear resistant coating may have an average thickness ranging from 2 to 10 mils in an embodiment. In other embodiments, coating 16 may be thicker or thinner than the aforementioned range.

Precipitation-hardened alloy body may be composed of an X—P alloy material (with X representing Cobalt) with the desired wear resistance properties, while also being susceptible to precipitate hardening through heat treatment. As a specific example, precipitation-hardened alloy body may contain at least 50% X and between about 5% and about 25% P, by weight, in embodiments. In other implementations, precipitation-hardened alloy body may consist essentially of X and P; and, perhaps, may contain about 10% to about 15% P, by weight, with the remainder of alloy body composed of X. The particular formulation or composition of precipitation-hardened alloy body will vary among embodiments depending, at least in part, upon the desired properties of wear resistant coating, the intended operational environment of coated component, cost considerations, and other such factors. If desired, micro-size or nano-size particles may be embedded in precipitation-hardened alloy body by, for example, co-deposition during plating to enhance or tailor certain properties of alloy body. Again, as indicated above and described more fully below, precipitation-hardened alloy body is suitably deposited utilizing an electroplating process in accordance with the novel configuration 100 as follows.

Figure 3:
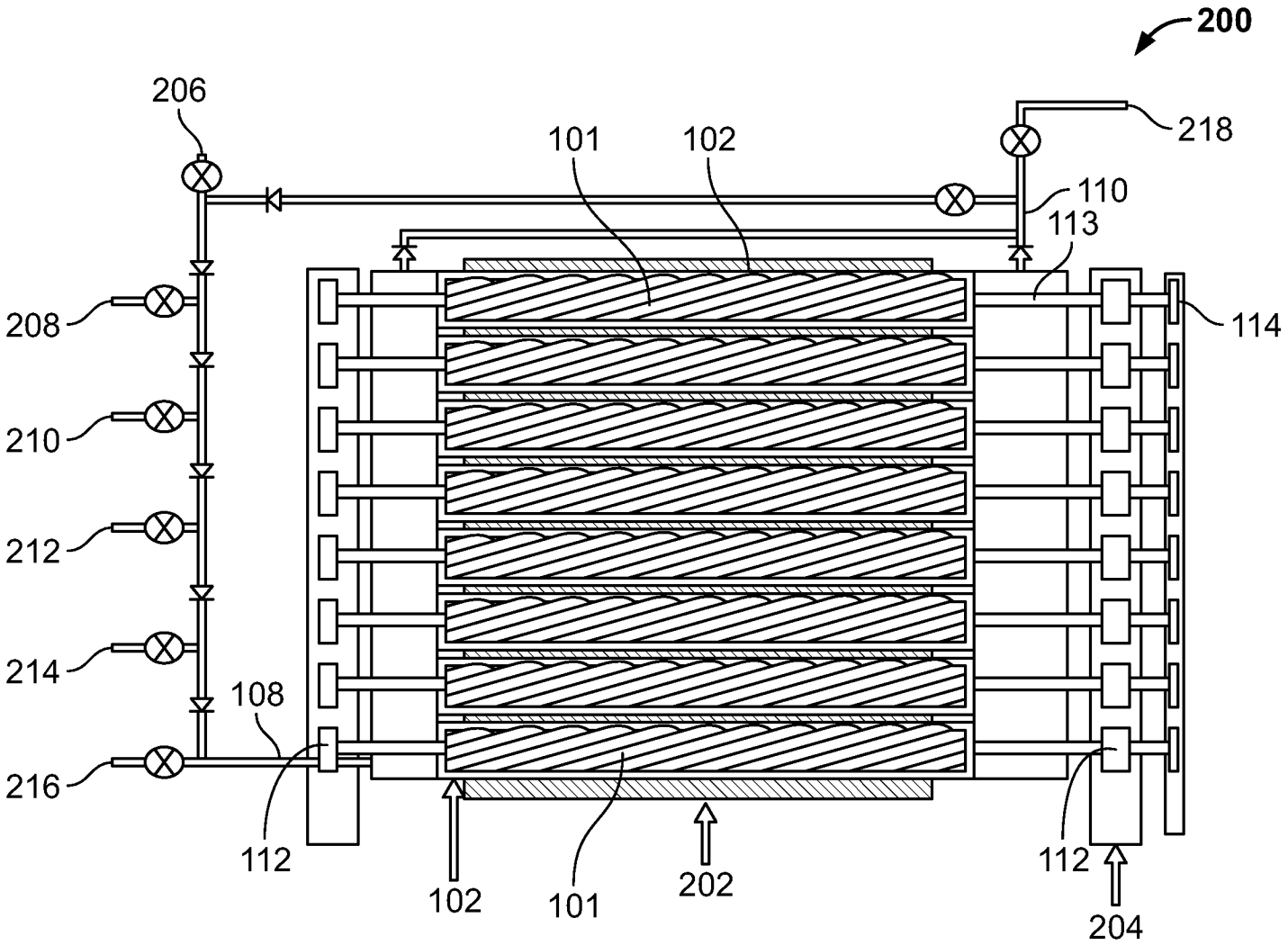
FIG. 3 is a top view illustrating the horizontally-oriented system for electroplating shown in FIGS. 1 and 2, including multiple electroplating tanks.

Turning now to FIG. 3, illustrated is a multi-tank configuration 200, suitable for describing the five typical process steps in the electroplating method in accordance with the present disclosure. As shown in FIG. 3, multiple tanks 102, each containing a part 101, are aligned in parallel with one another, and position over an anode platform 202, which may make a single or multiple connection to each tank 102. One or more cathode bars 204 are in contact with the shafts 113, which in turn are connected to the parts 101. Fill lines 108 are coupled with the tanks 102 to provide various processing solutions 206-216, and one or more return lines 110 are coupled with the tanks 102 and lead to a waste treatment reservoir 218. As indicated in FIG. 3, some processing solutions 206-216 may be recycled, if needed or desired. Although not separately illustrated, the each tank 102 may be outfitted with a gas removal line coupled to a hood, for removing hydrogen and oxygen gas that may be evolved during the process.

As a first step in the electroplating process, an electro-clean process is performed on each part 101 by supplying electro-clean fluid 208 to each tank 102. The first step of the electroplating process, as such, is preparing the surface of each part 101. This process of preparation is used as a way to enhance the surfaces for plating, removing any defects or contaminants to help ensure the best quality plating possible. Also known as electrolytic cleaning, "electro-cleaning" is commonly used as a preparatory step for metal parts before they undergo electroplating. This cleaning method involves introducing a controlled electric current to an electrolytic bath full of cleaning solution, which results in a vigorous cleaning of any parts immersed in the bath. The resulting electrochemical scrub is used to remove soil, grease and corrosive elements from any surface, no matter how deep-set. A suitable fluid 208 for the electro-clean process may include, in some examples, silicates, sodium hydroxide, phosphates, and/or surfactants.

Referring now to the next step in the electroplating process, an anodic etching process is next performed on each part 101. This etching is performed by introducing, for example, sulfuric acid 210 to the tanks 102. After the anodic etching process, a further acid etch may be performed using, for example, hydrochloric acid. Anodic etching is performed to remove any irregularities on the surface of the parts 101 in order to prepare the parts 101 for the electroplating, such that a more even and consistent plating surface can be achieved. In many embodiments, a hydrochloric acid dip step follows immediately after the anodic etching but prior to the following-described step.

The method continues by incorporating a strike layer onto each part 101. A strike layer, also known as a flash layer (flash nickel plating), adheres a thin layer of high-quality nickel plating to the base material. When different metals require plating to the product's base material, striking can be used. The nickel strike layer is formed so that oxides present on a surface of the metal plate do not affect the plating. The nickel strike layer is formed to serve as a seed layer or a catalyst for plating. When a plating layer is formed, any oxides on the metal plate will not hinder the subsequent plating process since the nickel strike layer is formed on a surface of the metal plate to serve as the seed layer. As illustrated in FIG. 3, a source of nickel ions 212 may be used for the strike layer.

Afterwards, a barrier or "under" layer can be plated over the surfaces of each part 101, in a subsequent method. For example, a barrier layer that does not harden significantly during the precipitation hardening step as described below, may be plated onto selected component surfaces. The chemicals 214 containing the necessary metal ions for this step may include, for example, a cobalt salt, preferably in combination with a suitable pH buffer. It should be noted that this under-layer is not the true base layer of the coating in the sense that a nickel strike layer had been previously deposited. The combination of the nickel strike layer and the instantly described barrier or under layer of nickel form only just a small fraction of the overall thickness of the coating.

During the next step of the coating formation method, the wear-resistant coating is electroplated over surfaces of the processed parts 101. The particular parameters and plating bath chemistries of the electroplating process may vary among embodiments. However, as a non-limiting example, Co ions 216 may be provided as a water-soluble additive, and, in an embodiment, may be added to plating bath solution. The plating bath chemistry may also be formulated to include other ingredients or constituents including pH balancing agents and/or chelating agents, such as organic acids. Other bath formulations are also possible, with fine tuning of other parameters (e.g., temperatures and agitation intensities) performed as appropriate for a particular plating bath operation.

Beyond the foregoing steps of the electroplating process described above, further steps may be performed in the manufacture of parts 101, such as mud rotors or other components. For example, machining of the newly-deposited layer may be conducted. Generally, conventional tooling and processes can be utilized to machine the rotor, and such machining operations may be performed to define detailed structural features, as desired. For example, in an embodiment, mechanical drilling, laser drilling, water jetting, electro discharge machining, or the like may be performed. Additionally or alternatively, grinding or polishing may be performed to impart the outer surface with a highly smooth surface finish. It should also be note that, between each of the foregoing steps of the electroplating process described above, deionized water 206 may be used to rinse the parts 101.

It is noted that either before or after the above-mentioned grinding step, one or more heat treatments may be performed. For example, a hydrogen embrittlement bake at about 190 C may first be performed. This may then be followed by a heat treatment to precipitate harden the wear-resistant coating. In at least some embodiments, the precipitation hardening heat treatment may be performed at peak temperature between 260 and 400 C (typically 300 C) for a time period ranging from 2 to 24 hours. After the heat treatments, the hardness value of the coatings beneficially exceeds 950 HV and, in certain instances, may have been increased by a factor of two or more.

Figure 4:
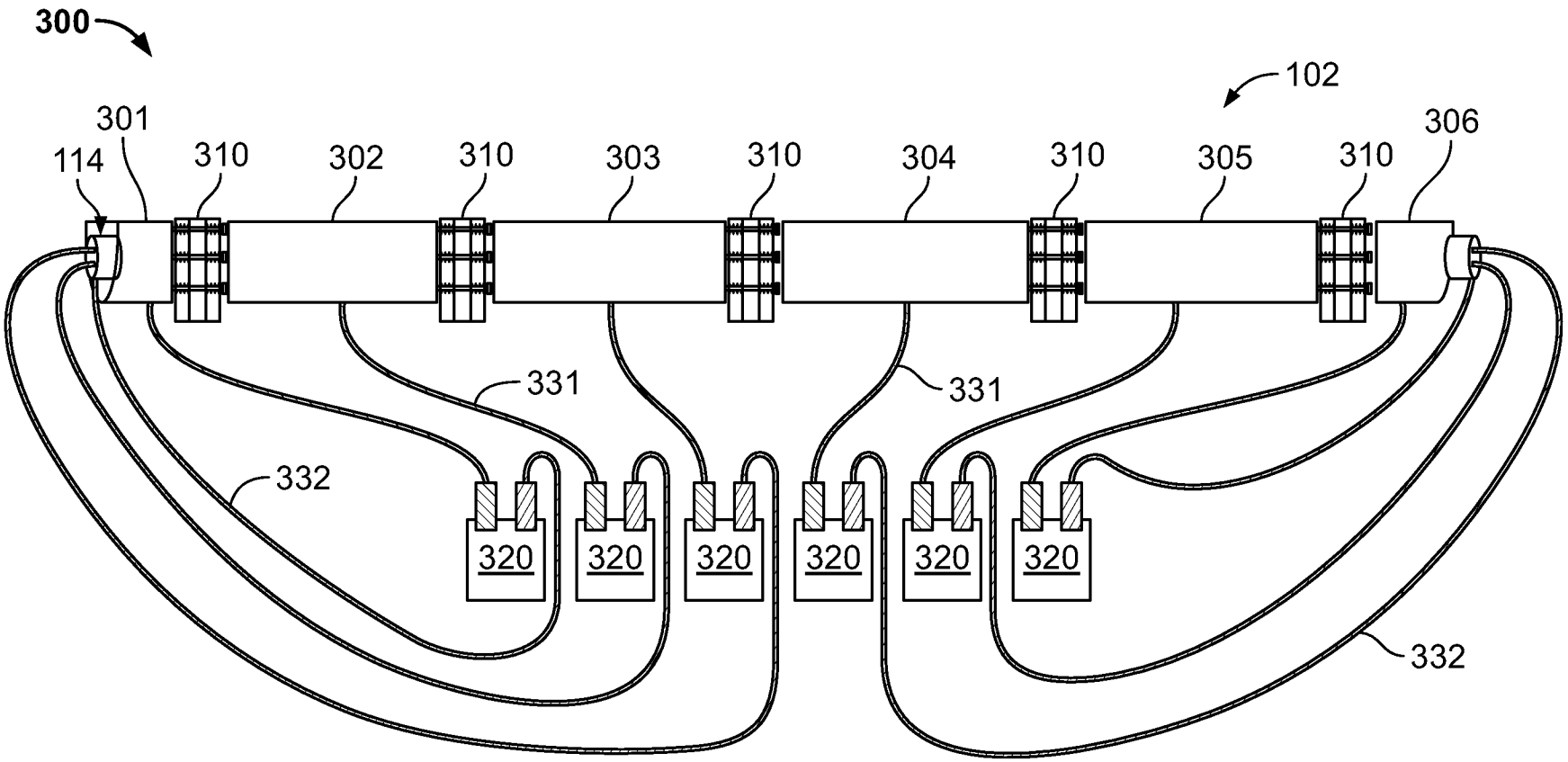
FIG. 4 is a side view of an alternative embodiment of a horizontally-oriented system for electroplating wherein the tank is configured in multiple segments.

In a variation of the foregoing embodiments shown in FIGS. 1-3, and with reference now to FIG. 4, it is also possible to "segment" the tanks into a plurality of electrically isolated segments 301-306, with dividing supports 310 positioned therebetween. Each segment 301-306 is separately connected to anode 331 and cathode 332 lines, via a plurality of rectifiers 320, thus allowing for more precise control of the electroplating conditions along the length of each part (not shown in FIG. 4). For example, the current in each segment 301-306 can be separately adjusted to increase or decrease the rate of electroplating, as desired.

Figure 5A:
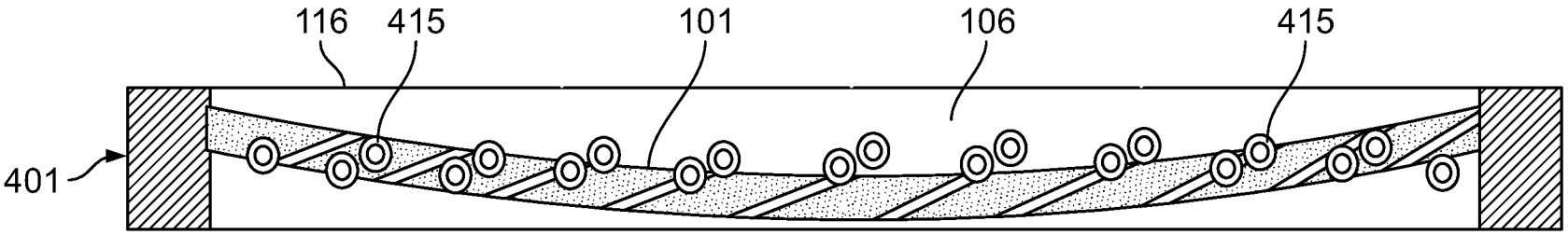
FIGS. 5A and 5B are side cross-sectional views of a horizontally-oriented system for electroplating without and with a tank deflectors, respectively, and suitable for use with any of the foregoing embodiments.
Figure 5B:
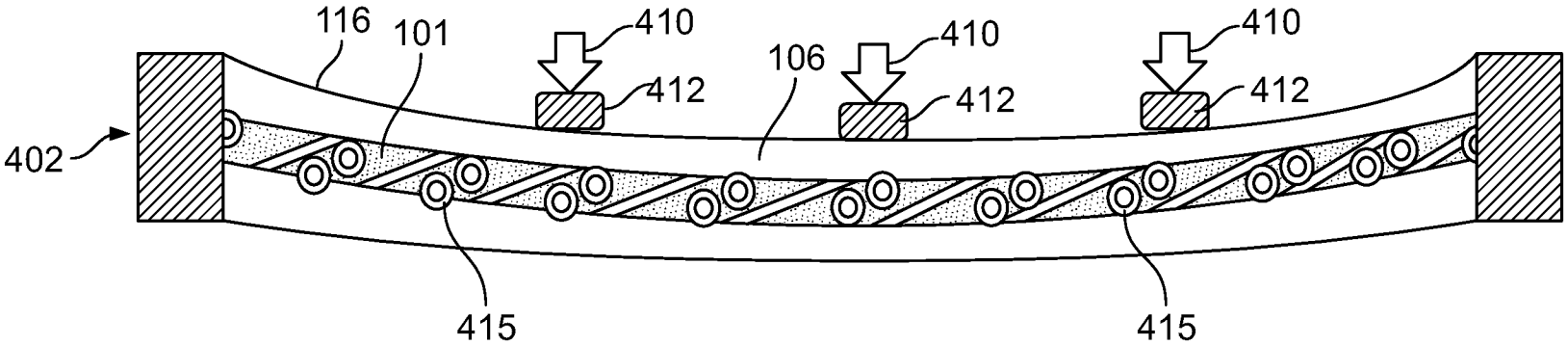

In a further variation of the foregoing embodiments shown in FIGS. 1-4, and with reference now to FIGS. 5A and 5B, the shield 116 may, in some embodiments, need to be deflected. In particular, as depicted in FIG. 5A, the part 101, when mounted in the tank 101, may sag under its own weight, resulting in a curvature thereof. As a result, the perforations 415 in the shield may not appropriately match the curvature of the part 101. However, as depicted in FIG. 5B, by positioning rollers 410 on top of the shield 116, the rollers 410 can apply a downward force to the shield 116, thereby deflecting the shield 116 so that it matches the curvature of the rotor 101 and maintaining a constant distance between part the 101 and the shield 116. The rollers 410 can each be optionally equipped with a micrometer 412 to precisely set the deflection at one or multiple points to match the rotor 101 deflection contour. In an exemplary embodiment, the rollers 410 are about a tenth of an inch in width.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope as set forth in the appended claims and their legal equivalents.

What is claimed is:

1. An electroplating system comprising:

a tank comprising an anode, wherein the tank is configured in a horizontal orientation having a length greater than its height;

a component part disposed within the tank and functioning as a cathode;

an electrical connection, coupled to the anode and cathode, for providing an electric current;

a current shield around the component part;

rollers positioned on top of the current shield to deflect the current shield downward to match any deflection of the component part; and a supply line for delivering an electrolytic fluid to within the tank.

2. The system of claim 1, wherein the component part is a mud rotor.

3. The system of claim 2, wherein the mud rotor has a length of about 8 feet to about 30 feet, and wherein the horizontal orientation of the tank is configured to house the mud rotor within its bounds.

4. The system of claim 1, wherein the electrolytic fluid includes ions of cobalt and ions of phosphorous.

5. The system of claim 1, further comprising a motor and shaft coupled to the component part for rotating the component part during an electroplating process.

6. The system of claim 1, wherein the current shield comprises titanium or a plastic.

7. The system of claim 1, wherein the current shield is spaced about ½ inch from the rotor.

8. The system of claim 1 comprising a plurality of tanks, each configured in the horizontal orientation, and oriented in parallel with one another.

9. An electroplating system comprising:

a tank comprising an anode, wherein the tank is configured in a horizontal orientation having a length greater than its height;

a component part disposed within the tank and functioning as a cathode, the component part disposed within the tank in the horizontal orientation;

a current shield disposed around the component part;

an electrical connection, coupled to the anode and cathode, for providing an electric current;

a supply line for delivering an electrolytic fluid to within the tank; and rollers positioned on top of the current shield to selectively deflect the current shield downward to match any deflection of the component part.

10. The system of claim 9, wherein the component part is a mud rotor.

11. The system of claim 10, wherein the mud rotor has a length of about 8 feet to about 30 feet, and wherein the horizontal orientation of the tank is configured to house the mud rotor within its bounds.

12. The system of claim 9, wherein the electrolytic fluid includes ions of cobalt and ions of phosphorous.

13. The system of claim 9, further comprising a motor and shaft coupled to the component part for rotating the component part during an electroplating process.

14. The system of claim 9, wherein the current shield comprises titanium or a plastic.

15. The system of claim 9, wherein the current shield is spaced about ½ inch from the rotor.

16. The system of claim 9, comprising a plurality of tanks oriented in parallel with one another.

* * * * *